US006969209B2

(12) United States Patent
Apar et al.

(10) Patent No.: US 6,969,209 B2
(45) Date of Patent: Nov. 29, 2005

(54) SOUND EMITTING DISPENSER

(76) Inventors: Paige Apar, 420 N. Kanan Rd., Oak Park, CA (US) 91377; Vanessa McGarry, 12 Birchwood, Oak Park, CA (US) 91377

( * ) Notice: Subject to any disclaimer, the term of this patent is extended or adjusted under 35 U.S.C. 154(b) by 0 days.

(21) Appl. No.: 10/688,404

(22) Filed: Oct. 17, 2003

(65) Prior Publication Data

US 2005/0084322 A1 Apr. 21, 2005

(51) Int. Cl.[7] ..... B43K 5/06; B43K 21/08
(52) U.S. Cl. ..... 401/175; 401/172; 401/75
(58) Field of Search ..... 222/39; 401/172, 401/194, 75, 52, 175, 195

(56) References Cited

U.S. PATENT DOCUMENTS

| | | | | |
|---|---|---|---|---|
| 3,907,441 A | | 9/1975 | Idec et al. | 401/75 |
| 3,917,417 A | | 11/1975 | Lang | 401/72 |
| 4,298,036 A | | 11/1981 | Horvath | 141/1 |
| 4,369,158 A | | 1/1983 | Woodruff et al. | 264/268 |
| 4,521,127 A | | 6/1985 | Tomburo et al. | 401/68 |
| 4,552,161 A | | 11/1985 | Hill et al. | 132/88 |
| 4,702,399 A | | 10/1987 | Davis | 222/390 |
| 4,801,929 A | | 1/1989 | Instance | 340/692 |
| 5,174,440 A | * | 12/1992 | Chiu | 206/38 |
| 5,573,341 A | | 11/1996 | Iaia | 401/172 |
| 5,771,925 A | * | 6/1998 | Lewandowski | 137/552.7 |
| 5,851,079 A | | 12/1998 | Horstman et al. | 401/174 |
| 6,315,163 B1 | | 11/2001 | Shu | 222/39 |

* cited by examiner

*Primary Examiner*—David J. Walczak
*Assistant Examiner*—Peter deVore
(74) *Attorney, Agent, or Firm*—Koppel, Jacobs, Patrick & Heybl; Michael J. Ram

(57) ABSTRACT

A dispenser for a solid, gel or paste product includes a sound generating component or transmitter which releases a preset audio message, or which can activate other devices, every time the product is delivered from the dispenser.

4 Claims, 3 Drawing Sheets

SOUND EMITTING DISPENSER

FIELD OF THE INVENTION

The invention is directed to dispensers or applicators for products, particularly products provided in a gel or solid tubular form which also include an audible or electronic output activated when the product is dispensed from the applicator by a twisting motion, clicking or pushing a button.

BACKGROUND

Sunscreens or skin lotions, antiperspirant and other cosmetic and toiletry products are often prepared as a gel like solid in a form or shape adapted to be comfortably applied to selected parts of the human body, referred to as a stick product. The invention is also suitable for a variety of products which are moldable into a selected solid shape and used by being rubbed against a surface, such as a glue stick or coloring products such as crayons, paint or ink dispensers. As an example, solid forms of antiperspirant or deodorant products may be produced by molding a liquid composition into a cylindrical solid stick form having a variety of cross-sections, usually circular, oval or elliptical. The stick is molded within or placed in a tubular dispenser shell generally corresponding to the cross-section of the delivered product. A mechanism is provided for advancing the stick from the shell and for retracting it after use.

The mechanism for advancing or retracting the stick product can comprise a platform or basket at a lower end of the stick within a tubular container and a means for moving the platform or basket relative to the container shell to expose the other end of the stick for use. While the product may simply be pushed from the shell, it is generally advanced by having the platform threaded on an axially positioned threaded rod which is rotated by means of a knurled knob or base attached to the lower end of the tubular shell.

There are numerous patents which show such devices. U.S. Pat. No. 4,702,399 to Davis, U.S. Pat. No. 4,552,161 to Hill, U.S. Pat. No. 4,521,127 to Tomburo et al, U.S. Pat. No. 4,369,158 to Woodruff et al, U.S. Pat. No. 4,298,036 to Horvath and U.S. Pat. No. 3,907,441 to Idec et al are examples of tubular stick dispensers which utilize a knob attached to a threaded drive rod which is rotated to move the support platform.

It has also been suggested that the dispensing function include an audible sound, such as a clicking sound provided by a ratchet connected to the knob, to indicate advancement or extension of the cylindrical product (U.S. Pat. No. 5,851,079 to Horstman and U.S. Pat. No. 5,573,341 to Iaia).

Still further, it is also known to include sound chips in conjunction with a dispensing device or connected to lids on containers. For example, U.S. Pat. No. 6,315,163 to Shu shows a pump dispenser for dispensing a liquid where pressure exerted by or on the pump device activates a pressure sensor, which in turn activates a sound chip which may emit sounds or a short music piece. U.S. Pat. No. 4,801,929 to Instance shows a medicine bottle with a screw cap. Turning or removing the cap can activate a sound chip within the cap, providing information regarding the product in the bottle or a warning to the user.

Sound chips and activating mechanisms are also used in other devices. For example pre-recorded, or recordable sound chips have been incorporated into toys, dolls, picture frames, medicine packages and greeting cards. U.S. Pat. Nos. 5,387,108 and 5,846,089, incorporated herein by reference, show such an assembly.

SUMMARY OF THE INVENTION

The invention comprises a device for simultaneously delivering, in controlled amounts, a shaped solid or semi-solid composition for dispensing or applying to a surface and activating a sound source operatively connected to the delivery means, the sound source providing an audible output such as a short verbal message, music excerpt or sound effect.

BRIEF DESCRIPTION OF DRAWINGS

The above and other objects and advantages of the present invention will become apparent from the following description when read in conjunction with the accompanying drawings wherein.

DETAILED DESCRIPTION

Figure 1:
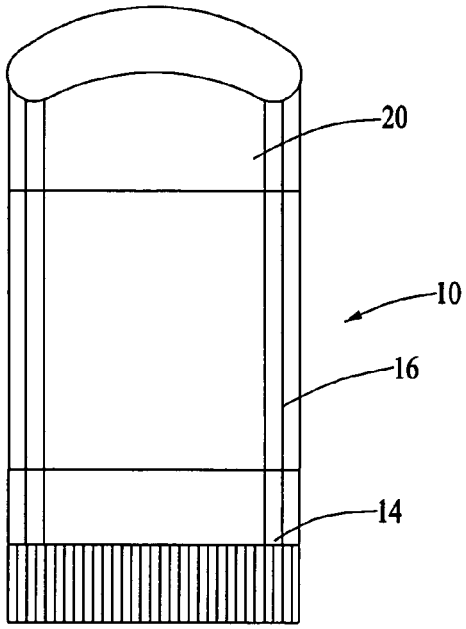
FIG. 1 is a side view of a device incorporating features of the invention.
Figure 4:
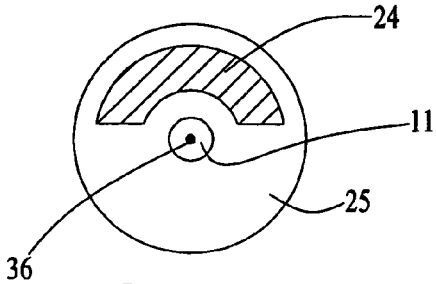
FIG. 4 is a view of the bottom surface of the tubular container portion of the device of FIG. 1.
Figure 5:
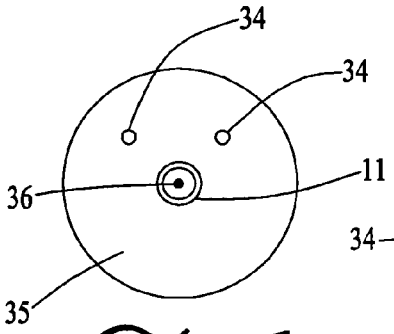
FIG. 5 is a view of the top surface of the control compartment of the device of FIG. 1.
Figure 2:
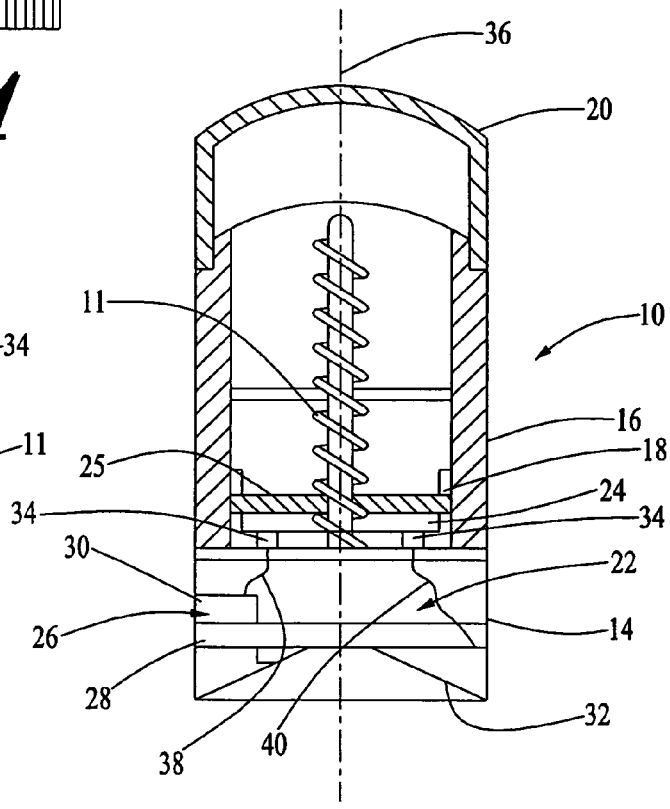
FIG. 2 is a cutaway view of the device of FIG. 1 showing internal components.
Figure 3:
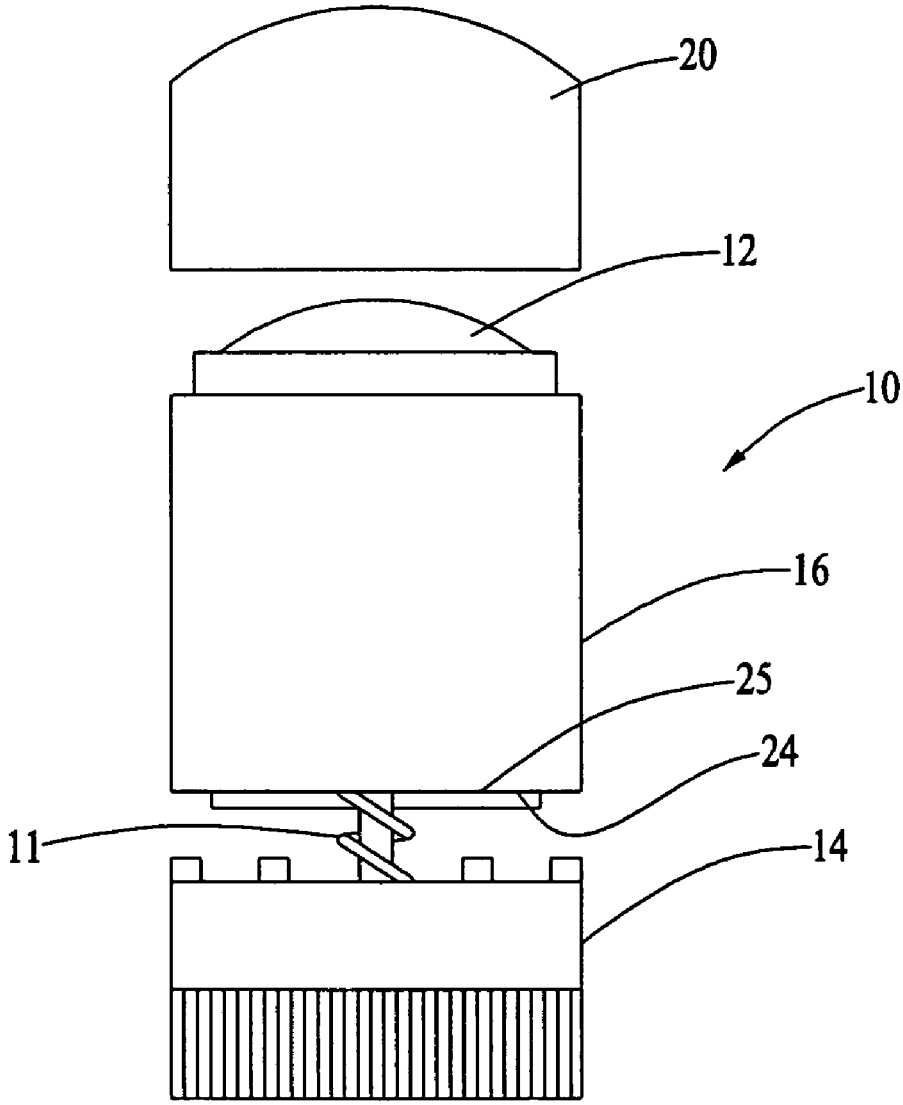
FIG. 3 is an expanded side view of the device of FIG. 1.

The invention relates to dispenser for a product which also includes a sound-emitting component, the delivery of sound being activated when the applicator is twisted to dispense its contents. Such a twist-activated dispenser can involve a point on the dispenser that a user manually twists to dispense, thus activating an audible response. Manual twist action by the user triggers a sound emitting device, more particularly, twisting a lower portion of the dispenser opens a trigger circuit sending a signal to a microprocessor which plays sound through a speaker. All are located within the base of the portable, self-contained product dispenser. As a alternative, the twist-dispenser can be include a sound blocking button. The button serves to disconnect the sound-transmitting portion of the dispenser when activated in conjunction with the twisting action.

Alternatively or additionally, a timer with an audible alarm can be included within the twist-dispense actuator. Dispensing the product by the twist action also activates the timer for a pre-determined (pre-programmed) amount of time at which point an alarm signal sounds, alerting the user of the "correct" time to reapply the dispensed product. For example, the twist dispenser can contain a sunscreen that must be reapplied every hour. The dispenser can measure this time and emit a sound (signal) of some kind to alert the user to reapply the product.

The invention contemplates the incorporation of the sound-emitting feature in any device that includes a twist action. Such a sound emitting device can be an electronic sound emitting device that has a pre-programmed noise, commercial slogan, commercial jingle, word, children's song, cartoon catch-phrase, advertising phrase, music, thematic tones, a sound-byte from a movie, sound effects, or other desired audible sound or signal. Also, optionally or alternatively, the sound-emitting device can include another or a different switch or other switches, such as a pressure-sensitive twist mechanism where it is desirable to combine pressure and twist motion such as removing a bottle top. For example, including the sound function within a twist-off child safety cap on a container. Twisting of the cap releases an audio warning and/or instructions.

Further optionally or alternatively, the invention contemplates dispensers wherein the sound-emitting device can include a VOX—a voice activated sound switch. For example, a user can record a personalized message. The user then uses an original password to trigger the audio recording. Additionally, and/or optionally, the invention can include a voice-recordable option whereby the user can custom record the sound to be played upon the twist dispense of product. For example, a user can record "I love you" into the microphone and hear the recording playback, "I love you" every time the product is twist dispensed.

Also optionally or alternatively, the invention can include two or more switches or other kinds of switches, such as an on-off switch. For example, if a user wishes to dispense the product without disturbing others, such as at movie theater, the sound could be turned off.

Still further, it is contemplated that the dispenser can include other functional devices activated by the twist action, for example an aroma dispenser or signal transmitter. Instead of or in addition to emitting an audio signal, the device can transmit a signal, such as an infrared (IR), radio (i.e., short-range FM), or other suitable signal. A remote receiver in the vicinity within each and every twist dispensing device that includes a signal receiver would then perform a preprogrammed response, such as emitting a noise, word, phrase, jingle, sound-effect, sound-byte, or other desired visible or audible signal or sound. Additonally, the receiving unit can be programmed to respond to such IR or radio transmission signals with a corresponding, yet different, sound. For example, the twist-activation of a first unit can emit, "GO Cowboys!" and any secondary unit within the transmission distance, i.e. 10 feet, would receive the signal and emit a programmed response, such as, "Fight, Fight Fight!". The same would apply to commercial jingles, and the like"—less filling . . . tastes great"—and so on. A further alternative would be the activation of a colored light in response to the transmitted signal.

The invention can also provide an educational message, ie. promote good sanitary or other behaviors, teach a word, assist those who are blind, or function as entertaining, promotional, or descriptive marketing tools.

Also described herein are methods for making and using such a dispense and components of such a dispenser.

Examples of products dispensed include, but are not limited to, a solid cosmetic such as sunscreen, lip gloss, lip stick, lip sunblock, solid cologne balm, mascara, moisturizers, glitter balms, glitter gels, body glitter, glow-in-the dark body coatings, body paint, nail polish, deodorant and liquids, gels or foams, such as tooth paste, shaving cream, scented or unscented lotions, nail polish, or crème blush. However, the dispensed product is not limited to cosmetics or other personal care products and can include a broad range of dispensable goods such as foods, candy, lollipops, condiments or spices or household products such as glue, room deodorizers, drink canisters, thermoses, pens, crayons and writing utensils, twist top bottles, etc. Further, the ability of the dispenser to emit sound when activated can assist those who are blind by identifying the product. Use of the invention described herein is not limited by the specific product dispensed by the device.

Further, the ability of the dispenser to emit sound when activated provides a novel and effective tool for marketing purposes. For example, corporate promotional products or give-aways can include a sound emitting device can be an electronic sound emitting device that has, but is not limited to, a pre-programmed noise, commercial slogan, commercial jingle, thought provoking words, children's song, recognizable slogans, trademarked sounds, copy-written music, sound effects, light-hearted advertisements, generational slang, etc. to be used with the intent of marketing and advertising.

The invention provides an excellent brand-building tool because of the ability to add sound to enhance a product's desirability and thereby make the product more memorable, thus providing the ability to instill brand recognition. Additionally, the twist to dispense activator can create a unique multi-sensory experience of sight, smell, and sound, especially when coupled with the delivery of cosmetics. Such a sound emitting device can be an electronic sound emitting device that has a pre-programmed noise, commercial slogan, commercial jungle, word, children's song, cartoon catch-phrase, advertising phrase, music, thematic music, sound-byte from a movie, sound effects, or other desired audible sound or signal. Also, optionally or alternatively, the sound emitting device can include another or a different switch or other switches, such as a combined pressure-sensitive twist mechanism where it is desirable to combine pressure and twist motion such as required in the removal of certain child proof medicine bottle tops.

While the preferred embodiment comprise cosmetic or candy dispensers with the sound activated by a twist action as a promotional and advertising tool, there exist numerous novelties which have various kinds of on-off switches, which may or may not be twist activated. For example, a glitter lipstick dispenser that plays "It's a small world" as it is dispensed, a cigarette lighter with a rotating or depressible activator that releases a flame while activating an audio output such as "Let Playboy light your fire . . . ", an applicator used on a product in connection with Valentine's Day, with the sound corresponding consistently. (e.g. "I Love You!"), an electrical or battery-operated device with an on-off switch, like a portable battery operated fan (used by sports fans during outdoor events) where turning on the device triggers a recording, such as "Have a cool day on us . . . ", or any number of devices that include a pull-trigger or push-button mechanism that also triggers the audio response, instead of a twistable base.

Cosmetics, liquids, writing implements, and lighters often deliver their contents from ordinary dispensers designed solely to deliver the product—as a means to an end. The enjoyment derived, if any, is limited to, and dependent upon the qualities of the product being dispensed. The experience is typically not multi-sensory or memorable. Furthermore, dispensers used in the promotional give-away and corporate advertising industry are limited in design to the images placed upon the exterior of the dispenser. The invention adds an audio or visual aspect to such ordinary products. Advertising professionals seek original, unique products which not only provide a source identity for their brand or product but which connect with a target demographic customer. The key is using music or sound to make a connection and to increase sales and product awareness. By adding the audio or other features discussed herein to existing products, consumers are given a further incentive to buy and businesses are given another outlet to advertise and enhance their product.

The Sound Emitting Dispenser described and claimed herein also provides an incentive to twist the dispenser to see what happens next. It can be timed to particular holidays, sporting events, movie releases, song releases, etc. which can be sold on-line, in store windows, next to registers, kiosks at amusement parks, movie premieres, etc. With younger users, the dispenser can encourage them to use the product that is contained in the applicator, such as sunscreen and other hygienic products. The sound-emitting dispenser can provide some entertaining dialogue, music, or sound. Once the product inside the dispenser is used, the dispenser can also be refilled.

The dispenser can also be designed and silk-screened to depict logos, pictures, trademarks, characters, people, brands and the like and then provide an audio output consistent with the logo displayed. For example, if the logo is for Coca-Cola, when the dispenser is twisted, then the sound may emit, "Have a Coke and a smile!" And thus, the twistable dispener produces a sound that is consistent with the appearance of the logo.

In a preferred embodiment of the invention, the means to dispense the product is accomplished by an applicator having a rotateable base that enables a user to twist up a basket or platform inside the tube which forces the contained product (i.e. sunscreen) to dispense, while emitting sound from a speaker.

A dispenser is provided for delivering a product in the form of a solid or semi-solid cylindrical shaped composition, an end surface of the cylindrical shaped composition being extended from a tubular carrier so that it can be rubbed across a target surface. The cylindrical shaped composition is extended from the end of the tubular carrier by pressure applied to a second surface, located on an end of the cylindrical shaped product spaced from and opposite of the first end. Pressure on the second end of the cylinder can be provided by applying a pushing pressure to a platform at the second end of the cylindrical product or rotating a knob located below the second end, or other common devices used to move a cylindrical rod through a tubular structure. A preferred embodiment utilizes a knob operatively connected to a shaft, the shaft having a spiral-shaped or screw-like outer surface. The outer surface of that rod interacts with a platform below the second end of the cylindrical product so that rotating the knob elevates the platform, in turn advancing the first end of the cylindrical structure out from the tubular carrier. A sound source, preferably a sound chip and attached speaker assembly are located within the assembly such that action taken to advance the cylindrical structure also activates the sound chip, causing the release of the audible sound from the speaker. The assembly can be constructed so that the sound chip is activated only the first time the cylindrical structure is moved in the tube, or every time the cylindrical structure is advanced, such as each time the knob is turned one revolution, or a partial revolution if so designed. The invention also contemplates activation of the same audio output each time the cylindrical structure is advanced, or the activation of different audio outputs, either in a planned or a random sequence.

Referring to FIGS. 1–5 an embodiment of a dispenser incorporating features of the invention comprises a standard cosmetic applicator 10 that, in this instance contains sunscreen, deodorant or other cosmetic or skin treatment composition. It comprises a standard twist applicator having a screw feed 11 a base 14, a tube 16 containing a cylinder of the material 12 to be applied to the skin (ie a SPF 30 or greater sunscreen), a basket 18, a cap 20 and the audio assembly 22.

Figure 6:
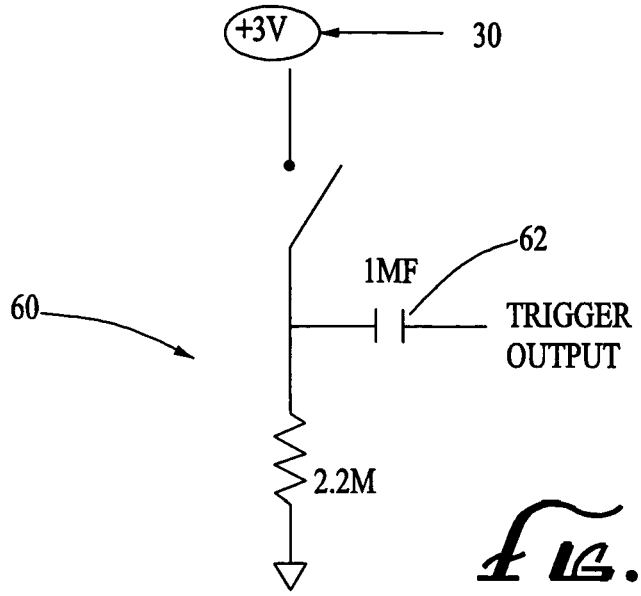
FIG. 6 is a schematic representation of a trigger circuit for use in the device of FIG. 1.
Figure 7:
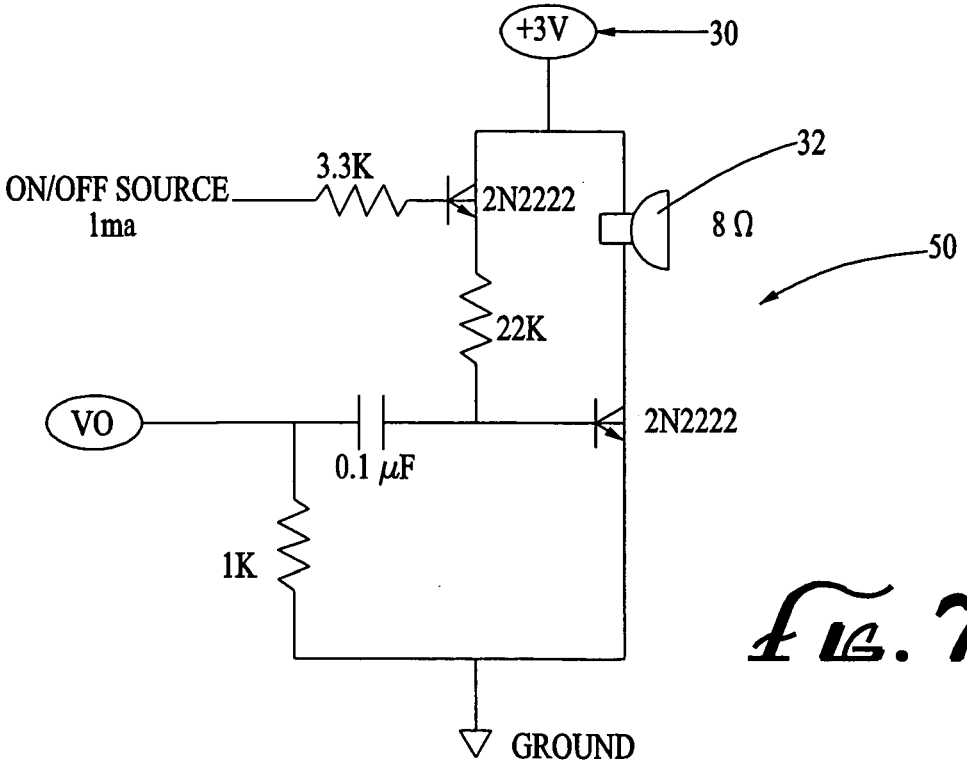
FIG. 7 is a schematic representation of an audio amplifier circuit for use in the device of FIG. 1.

The audio assembly 22, in the embodiment shown comprises a conductor piece 24, comprising a piece of metal attached to the bottom 25 of the applicator tube 16 and an electronics package 26 which is mounted in the base 14. The electronics package 26 in the embodiment shown comprises a sound generating chip, controller that contains internal memory and is pre-programmed to control performance of the product, an audio amplifier circuit 50 to amplify the sound delivered to the speaker 32, a trigger circuit 60 which includes a capacitor 62 which provides the trigger output to activate the sound chip, all of which are incorporated in a circuit board 28, a power source 30, such as one or more watch batteries, and a small speaker 32, preferably 1 inch or smaller in diameter. A suitable trigger circuit and audio amplifier circuit are shown in FIGS. 6 and 7. However, one skilled in the art will recognize that various different circuits, switches and electrical components can be used to accomplish the intended functionality described herein and the invention is not limited to use of the disclosed circuits.

The applicator 10 is typically about one inch in diameter, to house the speaker 32 at one end, and about 4½ inches long to house sunscreen or other materials to be dispensed. In the embodiment shown the conductor piece 24, attached to the bottom 25 of the tube 16, is contacted by two conductive posts 34 extending from the upper surface 35 of the base 14. One of the posts 34 is connected by a first conduit 38 to the power source 30, which in turn is in electrical communication with the input on the circuit board 28; the second post 34 is connected by the second conduit 40 to the electrical output from the board 28. When both posts 34 contact the conductor piece 28 an electrical current is transmitted from the power source 30 (a battery) to the capacitor 62 in the trigger circuit 60 on the circuit board 28. Rotating the base 14 around a centerline 36 of the applicator 10 causes both posts 34 to contact the conductor piece 24, completing an electrical circuit, thus opening or triggering the capacitor 62 in the trigger circuit 60 which in turn signals a microprocessor on the circuit board to be activated to play the audio message, activating the sound chip located on the circuit board 28. The microprocessor then reverts to its off-mode and waits for the next triggering event, which occurs when the base is rotated around the center line 36. A typical applicator 10 incorporating features of the invention can be activated at least 100 times to play a 10 second audio clip before battery failure. The device provides the opportunity to add an advertising jingle, musical sound bytes, voice recordings, movie sound clips, generic sound effects and tunes which are activated when the product is used (ie, the base is twisted).

One skilled in the art will recognize that an applicator such as described is not limited to the delivery of sunscreen, but may be used for the delivery of a broad range of materials including, but not limited to ink, crayons, markers, lip gloss (clear, colored, or flavored), eye-shadow with glitter, glow-in-the-dark cosmetic body paint and glue sticks, etc. Also, it need not be limited to delivering a cylindrical product as it can be applied to the delivery of any item that can be dispensed from a tubular structure such as hard candy, lollipops, jelly beans, etc. Also, the audio component need not be limited to a pre-packaged, pre-recorded audio output but may include the capability for a user to record a short message to be activated by using the dispenser or may include multiple messages which may be randomly accessed or triggered in a preset order. Additionally, a rope may be attached to the cap or base so the user can wear the product around his or her neck.

It is evident from the foregoing that there are many additional embodiments of the present invention which, while not expressly described herein, are within the scope of this invention and may suggest themselves to one of ordinary skill in the art. For example, different sized or multiple conductor pieces 24 and cooperating contacts can be used so that a full rotation is now required to activate the audio output, or different outputs could be triggered by different sets of conductor pieces and contacts. It is therefore intended that the invention be limited solely by the appended claims.

We claim:

1. A dispenser for a commodity, the dispenser also providing a time limited audio output comprising:

an upper portion containing a product to be dispensed, a lower portion comprising a rotateably mounted activator, the lower portion operatively connected to the upper portion, the lower portion and upper portion being oriented around a common central longitudinal axis there through, said activator rotatable 360° around the longitudinal axis, whereby every rotation of the lower portion partially or fully, as pre-determined, around the central longitudinal axis causes the product located in the upper portion to be dispensed therefrom, said rotation also substantially simultaneously activating a a capacitor coupled to a trigger circuit to release sound from an electronic component located within the upper or lower portion of the dispenser, the electronic component releasing the sound being electrically isolated by said capacitor from a battery provided for charging the capacitor, said sound released for a fixed period of time controlled by the energy stored in the capacitor.

2. The dispenser of claim 1 wherein sound is activated by rotating the lower portion a single revolution.

3. The dispenser of claim 1 wherein sound is activated by rotating the lower portion less than a single revolution

4. The dispenser of claim 1 wherein sound is activated by rotating the lower portion, said activated sound being the same or different each time activated.

* * * * *